United States Patent [19]

Miller

[11] 4,037,438

[45] July 26, 1977

[54] LOCKING DEVICE

[75] Inventor: Peter B. Miller, Fort Lauderdale, Fla.

[73] Assignee: Milschar Manufacturing & Development, Fort Lauderdale, Fla.

[21] Appl. No.: 611,076

[22] Filed: Sept. 8, 1975

[51] Int. Cl.[2] ..... E05B 73/00

[52] U.S. Cl. ..... 70/18; 70/DIG. 57

[58] Field of Search ..... 70/18, 229, 230, 232, 70/231, DIG. 57

[56] References Cited

U.S. PATENT DOCUMENTS

| | | | |
|---|---|---|---|
| 1,825,860 | 10/1931 | Gray | 70/230 X |
| 2,377,465 | 6/1945 | Turner | 70/230 |
| 3,600,914 | 8/1971 | Johnson | 70/232 |

*Primary Examiner*—Robert L. Wolfe

[57] ABSTRACT

A locking device including a securing member and a latching apparatus that is removably connectable to said securing member. The securing member includes an intermediate or bar means, a fixed positioning member or end portion at one end, and a connecting means adjacent the opposite end that may include a threaded portion and a non-circular surface portion. The latching apparatus includes mating connecting means for removably connecting the latching apparatus to the connecting means. The latching apparatus includes a locking mechanism for fixing at least one of the mating portions of the mating connecting means to at least one of the portions of the connecting means on the securing member. The improved securing member and latching apparatus are longitudinally and tortionally fixed together.

1 Claim, 9 Drawing Figures

LOCKING DEVICE

BACKGROUND OF THE INVENTION

In the past locking devices have been easily removed by manually operated bolt cutters and large wrenches. The present invention is not easily removed by such ordinary means. The present locking device concept and design provides great strength in a minimal size structure to prevent intrusion by bolt cutters, torsion devices, bending devices, prying devices, or tensioning devices.

BRIEF DESCRIPTION OF THE INVENTION

A locking device including a securing member and a latching apparatus. The securing member includes an intermediate means or bar between a connecting means and a fixed positioning member or end portion. The latching apparatus includes a locking mechanism and a mating connecting means that mates with the connecting means of the securing member. The two mating connecting means include a separation or longitudinal holding means and a tortional holding means. The two mating connecting means include a first holding portion and a second holding means. The intermediate means may be a bar of varying length that is placed in a chain link or hasp member to secure a chain or hinge member between the end portion of the securing member and the latching means.

The latching apparatus includes a housing, a rotatable member and a locking cylinder. The rotatable member of the latching apparatus includes a first mating holding means that is preferrably an internal thread in the rotatable member that is movably positioned and connected in the housing. The housing of the latching apparatus includes a second mating holding means that is preferrably an internal opening of non-circular shape, shown as a square opening. The housing is in the connecting end of the generally cup-shaped housing. The latching apparatus also includes a locking mechanism preferrably fixed in said housing and connected to said rotatable member to fix the position of the rotatable member relative to a key or other locking method by actuating said locking mechanism to an unlocked position or to fix the rotatable member from rotation when the said locking mechanism is in a locked position.

In use, the securing means is connected to the item to be secured. The housing with its mating second holding means, a non-circular mating portion, is placed over and connected to the second holding means of the connecting member. The mating second holding means prevents relative circular movement between the housing and the securing member. The rotatable member connected to locking cylinder in the housing is rotated by a key in the locking cylinder after the key unlocks the locking mechanism that is the tumblers. The mating second holding means in the rotatable member is connected with the second holding means, preferrably an external thread on the securing member to prevent separation of the housing from the securing member by movement in the direction of the longitudinal center line of the securing member.

It is an object of this invention to provide a locking device concept and design to achieve maximum strength in a minimum size of a single pin, rod, bolt or shaft and to prevent intrusion by bolt cutters, torsion, bending prying or in direct tension.

Another object of this invention is to provide a locking device providing a torque-carrying portion together with a tension-carrying portion of minimum physical size that develop full torque and tension strength of the securing member.

Another object of this invention is to provide full tension strength of the minor cross-section of the threaded portion securing one end of the locking device because no notches or grooves are necessary to accommodate pawls or similar locking means.

In accordance with these and other objects which will be apparent hereinafter, the instant invention will now be described with particular reference to the accompanying drawing.

DESCRIPTION OF A PREFERRED EMBODIMENT

Figure 1:
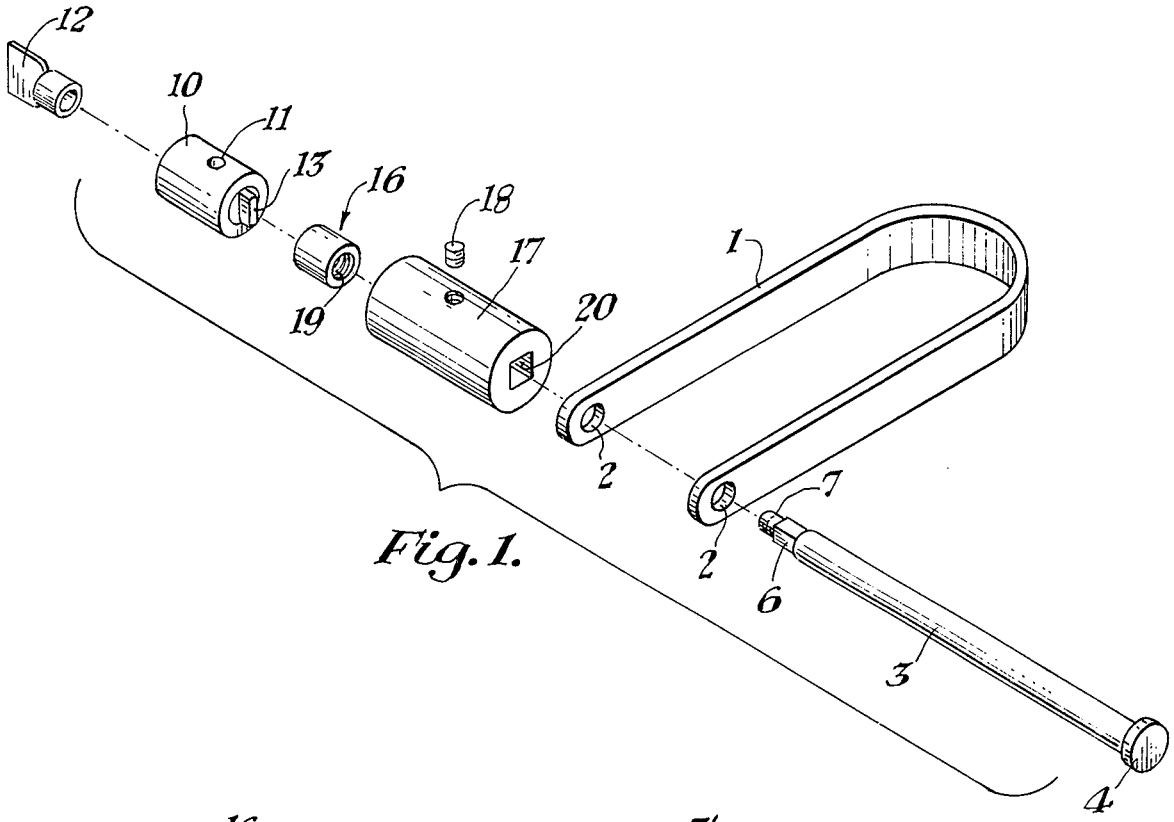
FIG. 1 is an exploded isometric view of the locking device and a locking item.
Figure 2:
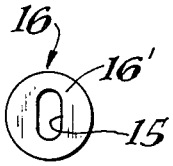
FIG. 2 is an end view of the rotatable member.

Referring now in detail to the drawing, wherein an embodiment of the invention is shown, and referring, particularly, to FIG. 1, the locking device including a member or securing means or member on the right and a latching means or apparatus on the left that are removably connectable to one another. The locking device may be used to lock many different items such as a U-shaped member 1. The member includes an intermediate or bar means 3, a fixed positioning member or end means 4 at one end and a connecting means 6 and 7 adjacent the opposite end that may include a first means or threads 7 and a second means or non-circular surface portion 6. The end means or portion may be enlarged or bulbous or may provide other securing structure. The latching apparatus or latching means includes a housing 17, a rotatable means or member 16, and a locking means or locking mechanism or locking cylinder 10. The rotatable member 16 of the latching apparatus includes a first mating holding means 19 that is preferrably an internal thread 19 in the rotatable member 16. The rotatable member 16 is rotatable in said housing 17. The housing 17 includes a mating second holding means 20 that is preferrably an internal opening of non-circular shape, shown as a square opening 20 in the connecting end or right end of the generally cup-shaped housing. The left side of the housing is opened to receive the rotatable member 16 and the locking cylinder 10. The latching apparatus also includes a locking means or locking mechanism in the locking cylinder, such as a lock. The locking cylinder 10 is preferrably fixed in said housing by threaded member 18 that passes through the housing 17 to engage opening 11 in the locking cylinder 10. The rotatable end 13 of the locking mechanism engage opening 15 in end 16' of the rotatable member 16 shown in FIG. 2. The rotatable end 13 connects said rotatable member 16 to the locking mechanism and in turn to key 12. The end 13 is freely rotatable when the locking mechanism is in an unlocked position. When the key or other locking means unlocks the locking mechanism the end 13 and the rotatable member are free to rotate.

The locking device may include a U-shaped member 1 with smooth round openings 2 and 2' in the distal ends thereof. The locking pin 3 includes an enlarged pinhead 4 at one end to stop movement to the left when pin 3 moves into openings 2' and 2. The second end of the locking pin 3 includes a securing means including square portion 6, with a distal end portion 7 that is threaded.

The threaded portion 7 is of a diameter not greater than the length of one side of the square portion 6. The threaded portion provides a strong tension coupling means. The square portion 6 may be rectangular, triangular or other non-round shapes. The non-circular portion provides a strong torsion coupling means.

The locking device includes a lock cylinder 10 with a pin hole 11 therein. The locking mechanism such as a Fort Lock SB 100 is of the well-known type that does not allow end 13 to freely rotate when the locking mechanism is in a locked position. The locking mechanism allows relative movement between the end 13 and the key 12 after the key places the locking mechanism in an unlocked position. When a matching round key 12 having a particular shaped end, not shown, is inserted into the lock cylinder 10, the rotation of key 12 rotates the locking end or flange 13. Flange 13 fits into an opening 15 in the face or end 16' of the rotatable member or cylindrical member 16. The locking flange 13 mates with opening 15 in face member 16'. Lock cylinder 10 and cylinder 16 are placed in the housing or socket 17 that may have a generally smooth internal surface. Pin 18 fixes the position of the lock cylinder 10 in relation to the housing or socket 17. The rotatable member 16 is rotatably positioned in housing or socket 17. The internal threads 19 of the rotatable cylinder 16 may be threaded onto and over threaded end 7 when rotatable member 16 is rotated by key 12. The square opening 20 fits over the square portion 6 of the locking pin 3 when the locking pin is passed through openings 2 and 2'. The rotatable member 16 secures the bar or pin 3 to housing or socket 17.

From the locked position, the locking pin 3 is released by turning key 12 to unlock the locking mechanism and to unscrew rotatable member 16 off threaded end 7. Thereafter, the locking pin 3 may be withdrawn from the locking members. To lock the locking pin in a closed position across the opening of the U-shaped member 1, the square end 6 passes through openings 2 and 2' and into opening 20 and the threaded end 7 is then secured to rotatable member 16. The key is turned in order to unlock the locking mechanism and to unscrew the rotatable member 16 from threads 7. Rotatable member 16 is permanently positioned between the end wall of housing or socket 17 and locking cylinder 10.

Figure 4:
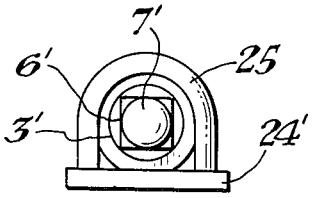
FIG. 4 is an end view of FIG. 3 without the strap.
Figure 3:
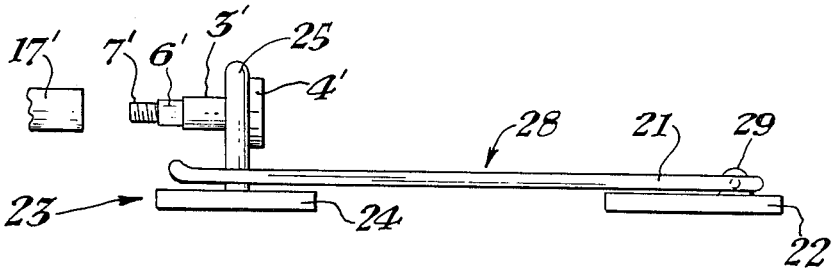
FIG. 3 is a side view of a portion of another locking device used on a hinged item.

Referring to FIGS. 3 and 4, the hasp includes a hinged member 28 and a staple 23. The hinged member 28 has a connecting plate 22, a hinge 29, and a strap 21 connecting plate 24 and a U-shaped member 25 over which the strap 21 may be moved, as shown in FIG. 3. A short pin 3' with pin head 4' and square portion 6' and threaded portion 7' may be placed in U-shaped member 25 as shown in FIGS. 3 and 4. The pin 3' may be secured by latching apparatus similar to 12, 10, 11, 13, 16, 19, 17, 18 and 20 of FIG. 1, a portion of which is shown as housing 17'.

Figure 5:
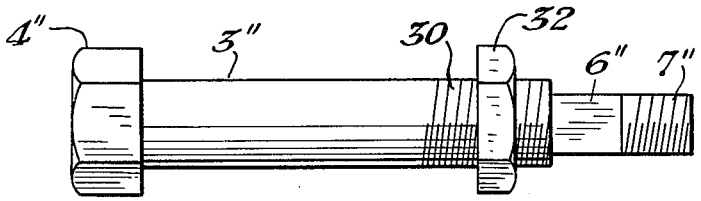
FIG. 5 is a side view of a second securing means.

In FIG. 5 the head 4'' is at one end of pin 3'' having a threaded portion 30 with nut 32. The pin may be secured to a wall between head 4'' and nut 32. At the other end of pin 3'' is non-circular portion 6'' and threaded end 7'' that may secure the nut by latching apparatus shown in FIG. 1.

Figure 9:
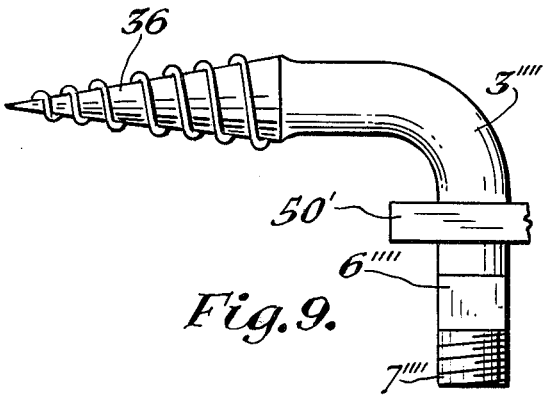
FIG. 9 is a side view of a fourth securing means.
Figure 8:
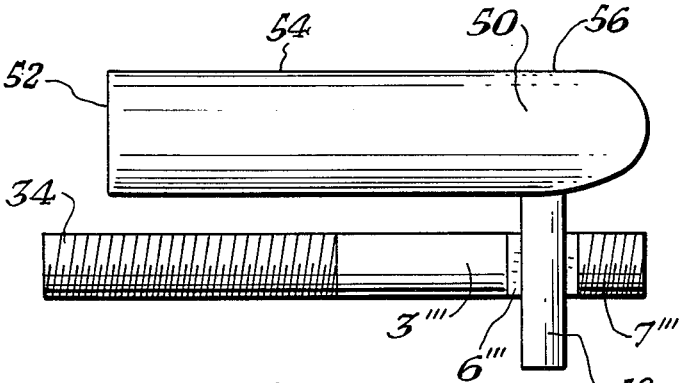
FIG. 8 is a side view of a third securing means.

In FIGS. 8 and 9 pins 3''' and 3'''' having ends 6''' and 6 '''' and 7 ''' and 7 '''' may be used to secure a larger device such as an outboard motor from being rotated to remove it from the transom of a boat. The pins are secured in a wall or transom by bolt threads 34 and screw threads 36 respectively. A housing or cap 50 or bar or clamp crank arm connector 50' may be placed over or connected to an outboard motor transom clamps device, not shown, and the ends of pin 3''' and 3'''' may be secured by latching apparatus shown in FIG. 1. The housing 50 is cupshaped with an opening at 52 and a slot 54 extending upward to point 56. Arm 58 may be welded to housing 50. Arm 58 includes an opening shaped to mate with non-circular portion 6'''. The housing 50 or bar 50' will keep the pin from being removed. The housing or cap 50 or bar 50' will prevent releasing of the outboard motor clamps under housing 50 or releasing of the outboard clamp by movement of crank arm or bar 50'.

Figure 6:
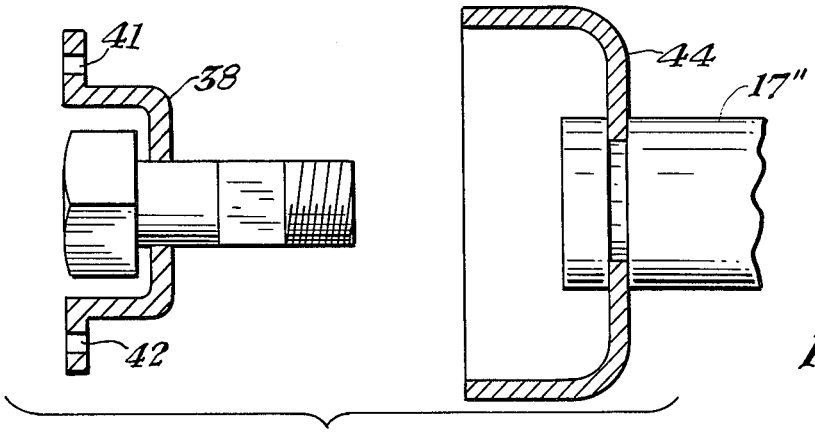
FIG. 6 is a side view of a securing means holding bracket.

In FIG. 6 the head end of the securing means as shown in FIG. 1 may be connected to a wall or other item by cap 38 having a screw holds 40 and 42. The screws may be secured by a second cap 44 attached around the housing 17''. The second cap 44 may rotate around housing 17'' or be fixed against rotation of housing 17''.

Figure 7:
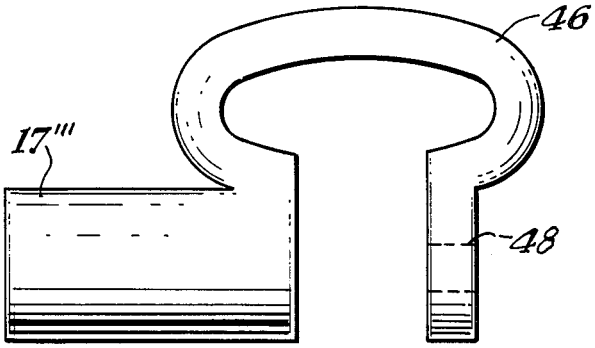
FIG. 7 is a side view of a second housing.

In FIG. 7 the housing body may include a U-shaped portion 46 with pin opening 48.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A locking device comprising:

a securing member and a latching means, said securing member including an intermediate means, a first end means connected to one distal end of said intermediate means, and a connecting means connected to a portion of said intermediate means for preventing separation from and relative rotational movement in relation to said latching means, and said latching means including a housing, a rotatable member held in said housing, and a locking mechanism connected in said housing and to said rotatable member, said housing and rotatable member including first and second mating means for mating with said connecting means to prevent relative separating movement and relative rotational movement, said connecting means including a first threaded means to prevent relative separating movement and second means to prevent relative rotational movement, said first mating means including a mating thread for mating with said first threaded means, a locking mechanism opening means, said second mating means includes a non-circular portion that is an opening in said housing, and said second means includes a non-circular portion in mate with said second mating means.

* * * * *